United States Patent [19]

Gilpatrick

[11] Patent Number: 4,589,884

[45] Date of Patent: May 20, 1986

[54] PROCESS FOR HEAT TREATING TEXTILE SUBSTRATES TO GIVE COLORED PATTERN

[75] Inventor: Michael W. Gilpatrick, Chesnee, S.C.

[73] Assignee: Milliken Research Corporation, Spartanburg, S.C.

[21] Appl. No.: 721,501

[22] Filed: Apr. 10, 1985

Related U.S. Application Data

[63] Continuation of Ser. No. 476,829, Mar. 18, 1983, abandoned.

[51] Int. Cl.[4] ..... D06P 5/00

[52] U.S. Cl. ..... 8/481; 8/485; 8/486; 8/487; 8/497; 8/115; 8/922; 8/924; 8/927; 8/933

[58] Field of Search ..... 8/481, 485

[56] References Cited

U.S. PATENT DOCUMENTS

| | | | |
|---|---|---|---|
| 3,153,106 | 10/1964 | Schlick | 8/444 |
| 3,177,644 | 4/1965 | Aspy et al. | 57/245 |
| 3,619,103 | 11/1971 | Williams et al. | 8/484 |
| 3,669,611 | 6/1972 | Shimauchi et al. | 8/481 |
| 3,880,579 | 4/1975 | Renaut | 8/471 |
| 3,888,623 | 10/1975 | Clarke et al. | 8/471 |
| 3,989,448 | 11/1976 | Bohrn | 8/481 |
| 4,086,112 | 4/1978 | Porter | 156/73.1 |
| 4,260,390 | 4/1981 | Lewis | 8/481 |
| 4,303,459 | 12/1981 | Kleber | 156/227 |
| 4,364,156 | 12/1982 | Greenway et al. | 26/2 R |
| 4,417,897 | 11/1983 | Stahl et al. | 8/481 |
| 4,452,605 | 6/1984 | Love | 8/494 |
| 4,499,637 | 2/1985 | Greenway | 26/2 R |

*Primary Examiner*—A. Lionel Clingman

*Attorney, Agent, or Firm*—George M. Fisher; H. William Petry

[57] ABSTRACT

A method is disclosed for heat treating textile substrates wherein a substrate may be dyed in pattern configuration and, optionally, thermally modified to produce visual surface effects in the pattern areas in perfect registry. Dye is applied to the textile substrate, and optionally dried, without being fixed. Heat is selectively applied in pattern configuration to the substrate. The heat is sufficient to fix the dye in pattern configuration, at a pre-determined level of fixation, and may also be sufficient to cause thermal shrinkage or other thermally-induced physical modification to the substrate, also in pattern configuration. Unfixed dye may then be removed, leaving a pattern-dyed substrate which, optionally, may have physically modified areas in perfect registry. A mixture of dyes having different fixation energy levels may be used for multiple color effects.

25 Claims, 4 Drawing Figures

PROCESS FOR HEAT TREATING TEXTILE SUBSTRATES TO GIVE COLORED PATTERN

This is a continuation of Ser. No. 476,829 filed Mar. 18, 1983 and abandoned.

This invention relates to a process for dyeing textile substrates in a pattern configuration. In one embodiment thereof, this invention relates to a process for simultaneously dyeing and thermally modifying components of a textile substrate in a pattern configuration, and in substantially perfect registry.

BACKGROUND OF THE INVENTION

Various techniques are known for dyeing a textile substrate in a pattern configuration. For example, it is well known that textile substrates may be dyed in a pattern configuration using a heat transfer printing process. In such processes, heat-sublimable dyes may be arranged in a pattern on an inert sheet such as paper. The paper is then brought into close association with the substrate surface to be dyed under conditions of heat and pressure. The dye sublimes and is transferred to the substrate in the vapor phase, where it condenses and is absorbed into the fibers comprising the substrate.

Using another technique, U.S. Pat. No. 3,619,103, to Williams, et al. describes a process for producing heat-induced effects on textiles or the like by means of one or more heated rollers. According to the teachings of Williams, et al., migration, heat fixation, and development of dyes on a textile substrate may be greatly accellerated through the use of such roller. The process of Williams et al., however, relates to a process wherein dye migration from one portion of the substrate to another is employed as the primary means to achieve a desired pattern. As a result of the liquid phase migration phenomenon, patterning the face of a fabric necessarily involves the patterning back of the fabric as well, and pattern areas tend to exhibit slightly "fuzzy" or indistinct edges. Also, large expanses of dyed fabric exhibit an "edge effect", wherein the edge of the dyed area contains more dye than the interior of such area, making such areas exhibit light and dark variations of the color rather than a single, uniform color. Furthermore, Williams, et al. does not suggest that an unpatterned textile substrate may be applied with dye in a pattern configuration and, substantially simultaneously, the dye in the dyed areas fixed, without the need for an additional process step. The process of Williams, et al. is also somewhat limiting in the sense that the substrate must generally be wet or have a high moisture content to permit patterning, and the time required by Williams, et al. for the preferred source of heat, i.e., the roller, to transfer sufficient heat to the substrate to initiate appreciable migration is relatively slow when compared to the process of the invention disclosed herein.

Processes which utilize the localized application of heat to impart a visual surface effect on a textile substrate are also common. Embossing techniques in which a heated roll or other heated member is pressed against the surface of a textile substrate in order to impart various visual surface effects such as surface sculpturing are well known in the art. As an example of patterning by means of heated air, U.S. Pat. No. 4,364,156 to Greenway, et al. discloses an apparatus for heat-treating the surface of a textile substrate by the pattern-wise application of a heated fluid such as air from selected locations along a slot in an elongate manifold, the fluid containing sufficient thermal energy to shrink or otherwise permanently thermally modify the visual appearance of the substrate in those areas contacted by the fluid. It is believed this technique results in a much more uniform heat treatment of the substrate as a result of, among other things, superior heat transfer to the individual yarns comprising the substrate surface. Under many circumstances, however, a higher degree of visual contrast in the thermally modified areas is desired than is commonly obtained using this technique.

It is also desirable under some circumstances to modify the color or hue of the areas contacted by the heated fluid streams, relative to the color or hue of the background. Differential dyeing techniques, wherein a substrate comprising synthetic fibers is initially heat treated to modify the quantity of dye later adsorbed by the treated fibers in a post-treatment dyeing step, are known in the art. Patterning the substrate using this technique has significant disadvantages, however. It is extremely difficult to obtain a dyed pattern appearing on a substantially undyed background using conventional differential dyeing techniques, making such techniques commercially impractical where, for example, a pattern using bright or dark colors is intended to appear on a substantially white or undyed background. The process of this invention can generate such commonly-required pattern combinations easily, and without the need for any printing step. Additionally, such differential dyeing techniques present a substantial difficulty in observing or inspecting the pattern areas for quality control purposes before the fabric is dyed. Prior to dyeing, some textile fabrics, when pattern-wise heat treated sufficiently to change significantly the degree of dye take-up in those heat treated areas, exhibit little visual contrast between the treated and untreated areas, making it extremely difficult to observe, and therefore inspect, the pattern areas prior to the dyeing step. The process of this invention eliminates this problem by applying the dye to the fabric prior to the patterning step rather than following such step. The dye which has been subjected to heat appears visually different than, and often darker than, dye which has had no such heat exposure, thereby making the heat treated areas readily visible during the patterning step.

Described herein is a novel process for patterning textile substrates wherein selected areas having enhanced contrast or a multi-tone pattern effect may be generated by the local, pattern-wise application of heat to areas of the substrate wherein one or more dyes have been applied. This process may also be employed where simultaneous dyeing and sculpturing, in perfect registry, is desired. This process overcomes the disadvantages recited above in connection with alternative dyeing processes.

Further details of the process of this invention may be understood after reading the following description and referring to the accompanying Figures, in which FIG. 1A is a process flow diagram for applying a dyed pattern, with an undyed background, to an undyed substrate;

DESCRIPTION OF VARIOUS EMBODIMENTS

Figure 1A:
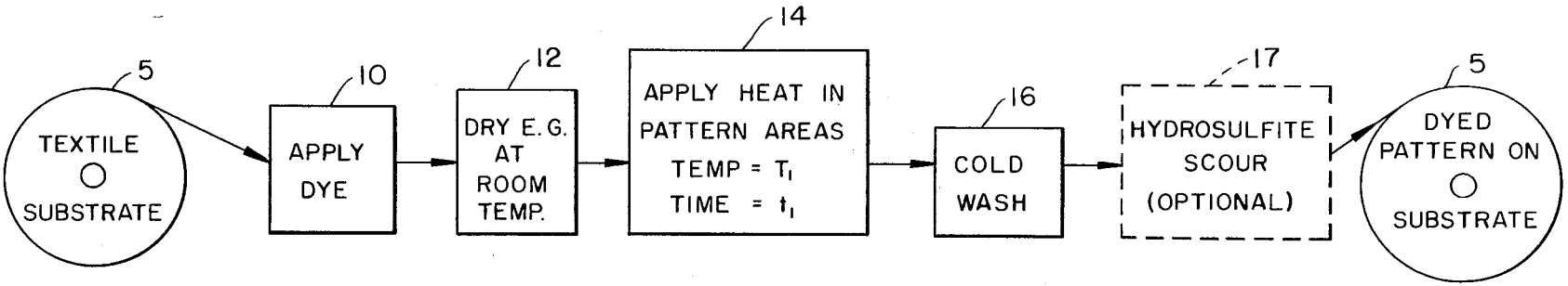
FIG. 1B is a process flow diagram for applying a dyed background to the pattern product of the process of FIG. 1A.

FIG. 1A summarizes the process steps by which one embodiment of this invention may be practiced. In this embodiment, an appropriate dye is applied to an undyed textile substrate comprised of a thermoplastic material, such as a textile fabric made from fibers of polyester, acrylonitrile, nylon 6, nylon 6,6, etc. Appropriate dyes for this purpose are considered to be those dyes which would customarily be used to dye such materials in conventional dyeing processes. The dye may be applied by means of a gravure or foam coating operation, by spraying, or by other conventional means for applying an appropriate dye to the desired textile substrate. It is generally preferred that the dye be applied uniformly if consistent, reproducible results are desired. The fabric may then be allowed to dry, preferably without exposure to elevated temperatures, although such drying may be considered optional. The amount of residual moisture left in the substrate may be adjusted to suit the specific process, and may be somewhat dictated by, for example, the means by which heat is applied to the substrate to fix the desired quantity of dye in a later process step. Additional moisture in the substrate may require the application of additional heat to achieve the desired dye fixation level or state of thermal modification of the substrate surface. It should be emphasized that the process of this invention does not require that the dyed substrate remain wet or be capable of permitting liquid phase migration of the dye over the substrate surface. It is considered an important advantage of this invention that the substrate, after being substantially uniformly dyed, may be dried and then shipped or stored for patterning at a later time or place.

If an undyed background is desired, it is important that the dye is dried, and the substrate handled or stored, under conditions which do not fix any part of the applied dye. For example, in dyeing polyester using disperse dyes, drying at temperatures less than about 220° F. or so have been found to be generally satisfactory, although lower temperatures may be found necessary under certain conditions. It should be understood, however, that certain dye systems do not depend upon elevated temperatures to "fix" in certain substrate materials, i.e., mere contact of the dye with the substrate may be sufficient to cause at least partial fixation of the dye on the substrate. In these cases, of course, maintaining an undyed background would require altogether avoiding contact between the dye and the areas of the substrate which are to remain undyed. See, e.g., Examples 1 and 3.

In the sense used herein, the term "fix" and its derivatives (e.g., "fixation") are intended to relate to the entry of the dye molecule into the individual constituent fibers or components of the substrate to a sufficient degree to render the dye associated with those fibers relatively light-fast and wash-fast. Reference to a "fixation level" as that term is used herein is intended to mean the relative quantity of dye which has been fixed on a specified area of the substrate. Areas in which large numbers of dye molecules per unit area of substrate surface have been fixed therefore may be said to have a high dye fixation level. Conversely, areas having a relatively small quantity, per unit area of substrate surface, of dye which has been fixed may be said to have a low dye fixation level. Generally, areas of relatively high dye fixation levels will appear visually darker or more saturated when compared with areas of relatively low dye fixation levels, assuming the process began with a white or light colored substrate and the same dye is used in all areas. After the dye solution has been allowed to dry, the substrate is then treated by the localized, patternwise application to the substrate surface of sufficient heat to fix a desired quantity of dye in the areas intended to carry the pattern.

Following this localized dye fixing process, the substrate may be washed in a cold wash to remove substantially all the unfixed dye in those areas not contacted by the heat. This may result in a textile substrate which carries a pattern area containing a pre-determined quantity or concentration per unit area of a fixed dyestuff which is viewed against a background or pattern-complementary area of the substrate which has not been dyed to any visually significant degree. It has been found that the process of this invention can yield background or image-complementary areas which contain no visually apparent residual dye level.

An optional scouring step is indicated in FIG. 1A. This step may be employed to clean the fabric, if desired.

It is also possible to pattern areas by both dyeing the pattern area and by inducing a thermally induced modification (e.g., inducing longitudinal shrinking, or localized minor melting or fusing, or pile yarn entangling) to at least some of the constituent fibers in the same pattern area. Where dyeing is to be combined with one or more of these other thermally induced effects, sufficient heat must be transferred to and absorbed by the substrate to produce two effects: (1) physical modification of the textile substrate surface as, for example, by substantially shrinking the yarn components of the substrate, by initiating limited melting of the yarn components, or by other thermally-induced physical changes to the constituent fibers or elements of the textile substrate, and (2) the fixing of the desired quantity of dye to a desired, pre-determined level, the dye having been applied and optionally dried in the previous steps of the process, described above. These two effects are achieved substantially simultaneously so far as the process steps of this invention are concerned, and are, of course, localized to those areas of the substrate where the heat has been directed in pattern configuration. Therefore, the physical modification to the constituent textile components of the substrate and the fixing of the dye applied to the substrate lie in exact registry, each having been the result of the same localized application of heat.

Figure 1B:
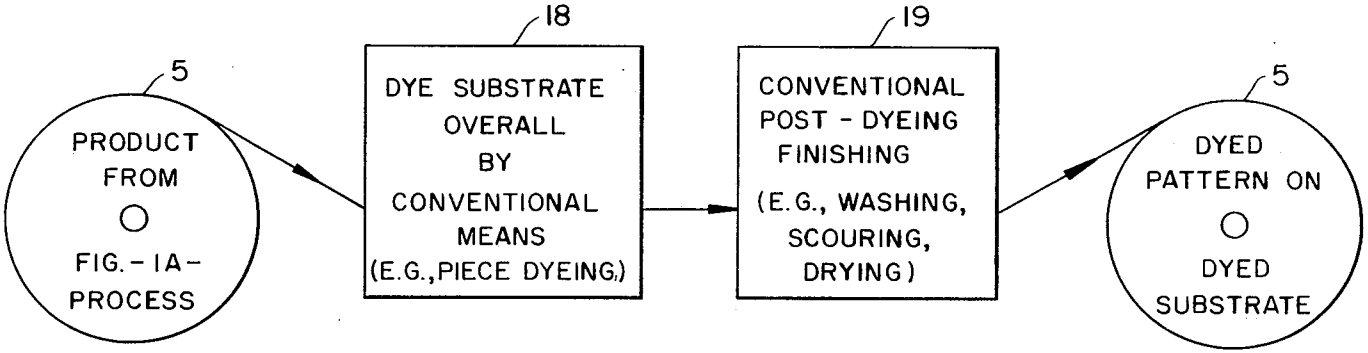

FIG. 1B summarizes additional process steps which define an embodiment of this invention in which it is desired to dye the background areas a different color from that of the pattern areas. As may be seen from FIG. 1B, the process steps are the same as those of the process of FIG. 1A, except that, following the cold wash step or the optional scouring step, the substrate is dyed in a conventional manner, followed by conventional post-dyeing finishing steps, e.g., washing, etc. By the process of FIG. 1B, a substrate having a dyed pattern of a given color viewed against a background of a second color may be produced. Because the second dyeing step will deposit dye on the entire substrate, including previously dyed pattern areas, some care must be exercised to assure that the final resulting color of the pattern areas as well as the background is that which is desired.

It should be noted that a previously dyed substrate may be dyed in a pattern configuration using the same process steps depicted in FIGS. 1A or, if desired, 1B. The result of the process of FIG. 1A is, for example, a patterned substrate in which the pattern, appearing in the color resulting from the application of dye in process block 10, is viewed against a background of the color displayed by the initial, unpatterned substrate prior to the application of dye in process block 10. If the process of FIG. 1B is employed, the original color of the substrate will influence the color obtained after each of the dye steps depicted in blocks 10 and 18.

Figure 2:
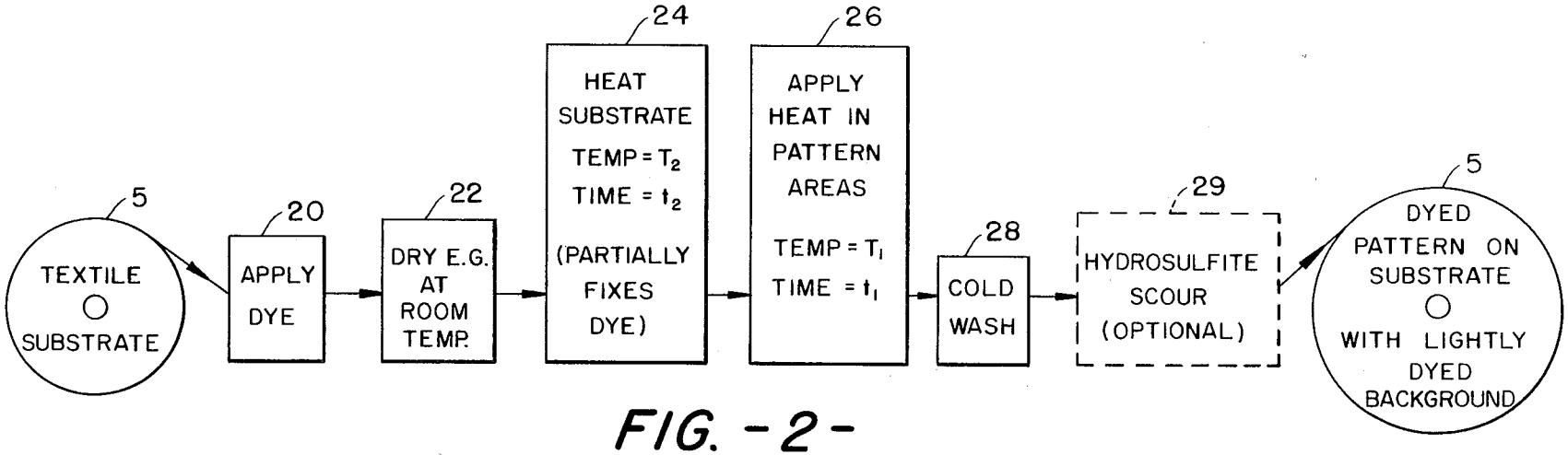
FIG. 2 is a process flow diagram for applying a dyed pattern, with a dyed background of a lighter variation of the same color as the pattern, to an undyed substrate. This process is not a part of this invention.

FIG. 2 schematically depicts a process, not an embodiment of this invention but rather independently developed and included herein only to facilitate full disclosure of the instant invention, in which a textile fabric is transformed into a dyed, pattern fabric in which the pattern areas of the substrate are a pre-determined color, and the background or pattern-complementary areas of the substrate are a color which results from fixing a quantity of the same dye as that residing in the pattern areas, but at a fixation level substantially different from the fixation level of the pattern area. If a red dye is used to pattern a previously undyed substrate, for example, the resulting pattern substrate may show a red pattern area against a pink (i.e., red dye fixed at a lower level) background. If a substrate which had been previously dyed a light or pale yellow were used in the above example and the fixation levels in the pattern areas is high, the same process steps may yield a substantially red pattern against an orange (i.e., yellow plus pink dye) background.

The process steps of FIG. 2 include process block 24, in which the applied dye is heated, in a controlled, uniform manner, to fix the dye at a relatively low, uniform level and establish the desired background color. Additional, local heating, either immediately or later, in a pattern configuration, as depicted in process block 26, fixes to a higher level the partially fixed dye on the substrate in the appropriate pattern areas, and thereby establishes a visually darker or more saturated color in the pattern area when compared with the background or pattern-complementary area. If desired, this pattern-wise application of heat may preceed the uniform heating step.

Figure 3:
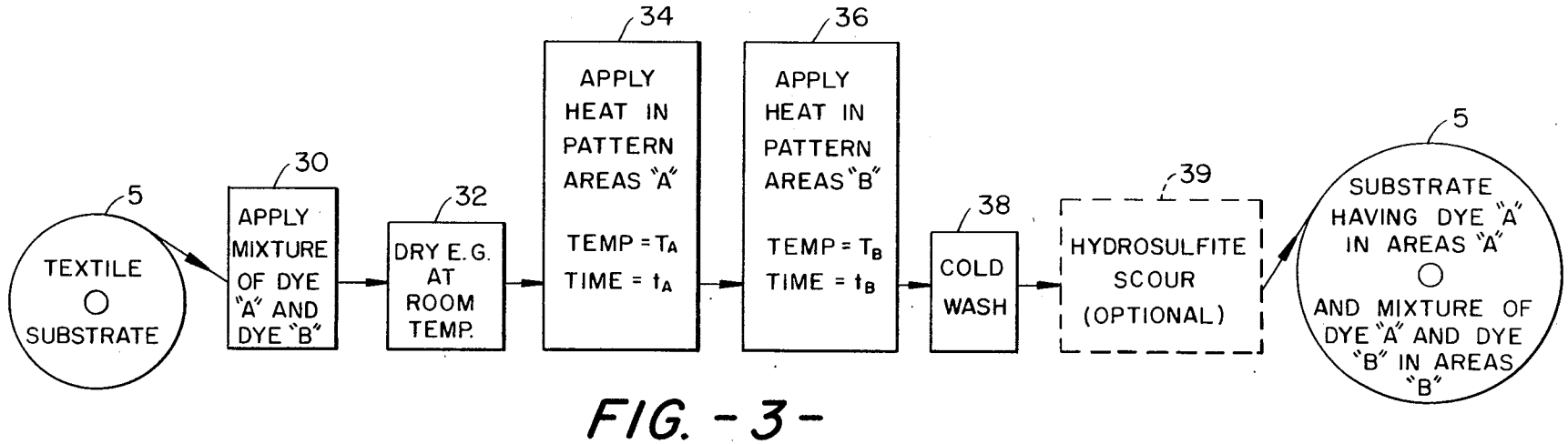
FIG. 3 is a process flow diagram for applying a dyed pattern in two colors to an undyed substrate.

Another embodiment of the process of this invention is depicted in FIG. 3. In the process of FIG. 3, a mixture of two dye materials of different colors and having substantially different dye fixation energies (e.g., requiring substantially different amounts of heat energy to achieve a given fixation level) may be applied simultaneously. The initial pattern-wise application of heat, in block 34, is of a sufficiently low temperature and/or for a sufficiently short duration to assure that most or substantially all of the dye fixed by this step is that having the lower dye fixation energy. The level at which this dye is fixed may of course be controlled in accordance with the desired pattern. Following this step, a second step (process block 36) involving the pattern-wise application of heat, perhaps in a different pattern configuration, is performed, at somewhat higher temperatures and/or for a longer duration. This second step is intended to fix all or a portion of the dye having the higher dye fixation energy in the desired pattern areas, and will of course fix additional quantities of the dye having the lower fixation energy which may be found in those same areas. The result is a dyed substrate which may contain a variety of different colors, depending upon the initial color of the substrate, the colors of the chosen dyes, and the distribution of the heat energy over the substrate surface which is applied during each of the steps. The heat may not only be applied to different pattern areas at each heating step, but the heat may be non-uniformly applied within a given pattern area at each step, resulting in pattern areas in which a given dye has been fixed at different levels of fixation, or in which the substrate has been thermally modified to different degrees.

It is also recognized that combinations of the above processes may be employed. For example, the process of FIG. 3 may be followed, except for the addition of relatively low level, uniform heating of the substrate, similar to that performed in process block 24 of FIG. 2, preceding or following the pattern-wise application of heat, in order to fix dye materials uniformly over the substrate, but at a relatively low fixation level, in order to establish a visually distinguishable background area.

It should be understood that any suitable method for applying sufficient heat to the substrate to fix the desired quantity of dye as well as generate thermally induced modifications to the substrate may be used in connection with this invention. For example, a laser of the appropriate type may be modulated according to pattern information and scanned over the surface of the substrate to induce fixation of the dye and, optionally, fiber shrinkage, fusing, etc., in a desired pattern configuration. (See Examples 6 and 7) An infra-red heat source, perhaps used in conjunction with a mask or stencil defining the desired pattern, may also be used.

Preferably, the method or means by which the heat may be applied to the substrate in a pattern-wise configuration to affect a chosen dye fixation level is one which will result in a controlled, reproducible quantity of heat being transferred to the pre-selected areas of the substrate without having an undesired effect on the substrate, for example, the crushing of the fabric pile if a pile fabric is used. It is also preferred that the heat be capable of being uniformly applied across the length and width of the substrate, and that the heat be capable of being distributed within the substrate to permit fixation of dye throughout the substrate structure, when and where such fixation is desired. If maximum versatility is desired, it is preferred that the heat source be one which allows for the modulation of the temperature and/or exposure times within selected portions of the pattern area, which would permit, for example, gradual shadings or variations in color within a given pattern area.

One means for applying the requisite amount of heat which has been found to be particularly advantageous involves the use of selectively controlled streams of heated fluid, such as hot air, which impinge on the substrate in a pattern configuration. For example, a reservoir of pressurized heated air may be closely positioned across the width of a substrate to which dye has been applied. Individual streams of relatively hot air may be directed from the reservoir onto the substrate surface. These individual streams may be regulated by introducing a second stream of air or other fluid, at a relatively lower temperature and higher pressure, into a respective selected stream of the heated air, for purposes of blocking, diluting, or otherwise interrupting the flow of the stream of heated air. The individual streams of relatively cool air may each be controlled by a respective valve which is actuated in response to pattern information supplied by a computer or other means. By controlling the actuation and pressure of these cooler air streams, the amount of heat transferred to selected areas of the substrate by the hot air can be regulated, for example, by effectively diluting or rapidly interrupting the hot air stream before it impinges on the substrate, or by completely blocking or deflecting the path of the hot air stream. In this way, areas of the substrate may be subjected to various degrees of heating, and therefore various levels of dye fixation and thermal modification, i.e., shrinking, melting, etc., resulting in the capacity to produce a wide variety of visual surface effects. Examples of suitable apparatus which may be used for producing streams of heated air as described above are disclosed in commonly assigned U.S. Pat. No. 4,364,156 and commonly assigned U.S. patent application Ser. No. 253,135, filed April 13, 1981, which disclosures are hereby incorporated by reference.

Use of the process of the present invention may be illustrated by the following examples, which are specific and not intended to be limiting. Unless otherwise specified, the apparatus used to apply the desired heat was one similar in overall operation to the hot air apparatus disclosed in U.S. Pat. No. 4,364,156 and U.S. patent application Ser. No. 253,135. The elongate heated air manifold was positioned approximately 0.20 inches from the substrate surface, and air heated to approximately the indicated temperature was directed toward the substrate surface at a pressure of approximately 0.8 p.s.i.g through a slot which extended along the length of the manifold. The air temperatures given were measured immediately prior to the air entering the manifold, and may therefore be somewhat higher than the temperature of the air which actually impinged on the substrate. The temperature of the air needed to achieve the desired results will of course depend upon the type of dye used, the level of fixation desired, the nature of the substrate, the nature of the additional thermally induced modifications desired (if any), etc. The term "sculpturing" as used hereinbelow is intended as a generic term to include longitudinal shrinking or localized melting or fusing of individual yarns, or yarn entangling, or other processes which would result in the visual patterning of the substrate surface.

EXAMPLE 1

A padding bath was made up according to the following formula: 987.5 grams water, 10 grams of the coloring agent, Foron Blue SBGL (powdered), a product of Sandoz Color and Chemicals, Inc. of E. Hanover, N.J. 07936, having a Color Index Name of Disperse Blue 73, and 2.5 grams of Natrasol EX, a hydroxyethyl cellulose compound marketed by Hercules, Inc., Wilmington, Del. 19899. Three samples of fabric were selected, all manufactured by Milliken & Company, Spartanburg, S.C. 29304, as follows: (1) a nylon-LYCRA raschel knit (LYCRA is a trademark of E. I. DuPont), identified by Milliken & Company as Style No. 2410, having a weight of 5.1 oz. per square yard; (2) a 44 gauge double needle bar raschel knit polyester pile fabric, identified by Milliken & Company as Style 6590, having a weight of 13.75 oz. per square yard; (3) an acrylic tufted fabric, identified by Milliken & Company as Style No. 5299, having a weight of approximately 13 oz. per square yard and a pile weight of 7.93 oz. per square yard, and a 100% polyester woven tufting substrate. These fabrics were wet out by being dipped into the padding bath above and run through a laboratory padding device set at a pad pressure of 30 lbs. The fabrics were air dried at 70° F. and processed with streams of heated air from the apparatus described above. The times given below represent the maximum time the pattern areas of fabric were directly impinged by the heated air streams as the fabric passed under the heated air manifold. Following this processing, the fabrics were washed in cold water in a household-type washing machine, using a household laundry product to remove unfixed dye. The fabrics were then tumble dried in a household-type dryer on a permanent press setting. The results are as indicated below.

| Fabric | Temp. (°F.) | Treatment Time (seconds) | Results (Coloring/ Sculpturing/ Dye in Background) |
|---|---|---|---|
| nylon-LYCRA knit | 850° | 0.030 | excellent/excellent/ moderate |
| polyester pile knit | 800° | 0.055 | excellent/excellent/ very slight |
| acrylic tufted | 910° | 0.036 | excellent/excellent/ slight |

EXAMPLE 2

The procedures of Example 1 were repeated, except that the coloring agent in the padding bath was Telon Blue BRL-200 (Color Index Name Acid Blue 354), a product of Mobay Chemical Co., Dye and Pigment Division, Union, N.J. 07083. The results are given below.

| Fabric | Temp. (°F.) | Treatment Time (seconds) | Results (Coloring/ Sculpturing/ Dye in Background) |
|---|---|---|---|
| nylon-LYCRA knit | 850° | 0.030 | excellent/excellent/ moderate |
| polyester pile knit | 800° | 0.055 | poor/excellent/ none |
| acrylic tufted | 910° | 0.036 | poor/excellent/ none |

EXAMPLE 3

The procedures of Example 1 were repeated, except that the coloring agent in the padding bath was Basacryl Blue RGL (Color Index Name Basic Blue 60), a product of BASF Wyandotte, Charlotte, N.C. 28266. The results are given below.

| Fabric | Temp. (°F.) | Treatment Time (seconds) | Results (Coloring/ Sculpturing/ Dye in Background) |
|---|---|---|---|
| nylon-LYCRA knit | 850° | 0.030 | fair/excellent/ very slight |
| polyester pile knit | 800° | 0.055 | good/excellent/ very slight |
| acrylic tufted | 910° | 0.036 | excellent/excellent/ slight |

EXAMPLE 4

The procedures of Example 1 were repeated, except the coloring agent in the padding bath was Solophenyl Blue 2RL (Color Index Name Direct Blue 80), a product of Ciba Geigy Corporation, Greensboro, N.C. 27419. The results are given below.

| Fabric | Temp. (°F.) | Treatment Time (seconds) | Results (Coloring/ Sculpturing/ Dye in Background) |
|---|---|---|---|
| nylon-LYCRA knit | 850° | 0.030 | none/good/none |
| polyester pile knit | 800° | 0.055 | none/good/none |
| acrylic tufted | 910° | 0.036 | poor/good/moderate |

EXAMPLE 5

The procedures of Example 1 were followed, except as noted below. A combination of two dyes, Polyester Yellow 2R (Color Index Name Disperse Yellow 86) and Polyester Blue BLF (Color Index Name Disperse Blue 77) both supplied by Eastman Kodak Company, Rochester, N.Y., were used in the process depicted in FIG. 3. The dyes were mixed in a 1 part blue to 4 parts yellow ratio (by volume) prior to application, to achieve a total dye solids concentration of 1% in water. A small amount of a binder, an acrylic polymer product of Milliken Chemical, Inman, S.C., identified as "PD-75", was also used. The fabric was a flat woven polyester fabric comprised of 100% textured polyester yarns, having a weight of 6.3 oz. per square yard, dyed white. This fabric is identified by Milliken & Company as Style No. 205. The heat treatment was done by a flat, electrically heated plate.

The dye was applied by a laboratory padder at 30 lbs. pressure to swatches of the fabric and then air dried at 70° F. until substantially dry. The individual swatches were then heat treated by the heated plate for the times and temperatures listed below. A spectrophotometer (Model II, manufactured by Diana-Hardy Corporation of Woburn, Mass.) was used to determine the extent to which each of the two constituent dyes had been fixed under various conditions. This relative fixation level is indicated in the columns marked "Yellow Conc." and "Blue Conc.", which give the relative concentration of the respective dye constituents. The column marked "B/Y Ratio" give the ratio of blue to yellow dye which was fixed at the indicated time and temperature. A B/Y Ratio of 0.25 indicates that the quantity of each dye fixed was proportional to the quantity of each dye originally applied (the original dye formulation had a B/Y Ratio of 0.25). Higher temperatures and/or longer treatment times do not affect this ratio, but do increase the total quantity of dye which is fixed in accordance with the 0.25 B/Y Ratio. Accordingly, once the B/Y Ratio reaches 0.25, higher temperatures and/or longer treatment times should not change the ratio of blue to yellow dye fixed by the process or seen by the eye, but instead merely change the "depth" or "strength" or "saturation" of the color which results from the 1 to 4 mixture of the two dyes. The results are as follows:

| Temp. (°F.) | Time (Sec) | Blue Conc. | Yellow Conc. | B/Y Ratio | Visual Appearance |
|---|---|---|---|---|---|
| 100° | 5 | 0.0090 | 0.0071 | 1.26 | White |
| 125° | 5 | 0.0193 | 0.0110 | 1.75 | Very Pale Blue |
| 150° | 5 | 0.0855 | 0.2880 | 0.29 | Very Light Green |
| 200° | 1 | 0.0212 | 0.0093 | 2.20 | Very Light Blue |
| 200° | 5 | 0.197 | 0.818 | 0.24 | Light Green |
| 200° | 15 | 0.202 | 0.775 | 0.26 | Medium Light Green |

-continued

| Temp. (°F.) | Time (Sec) | Blue Conc. | Yellow Conc. | B/Y Ratio | Visual Appearance |
|---|---|---|---|---|---|
| 200° | 30 | 0.287 | 1.10 | 0.26 | Medium Green |

EXAMPLE 6

The procedures outlined in FIG. 1 were followed, except as noted below. A laser was used, rather than the apparatus used in Examples 1–5, to apply the requisite heat to the pattern areas. The fabric used was a previously dyed flat woven polyester, having a weight of 6 oz. per square yard, and comprised of 100% textured polyester filament yarn. This fabric is identified by Milliken & Company as Style No. 4920. The dye used was an aqueous dye dispersion (total dye solids of 6% by weight) of Terasil Black MF-1, distributed by Ciba Geigy Corporation, Greensboro, N.C. 27419, to which a small quantity (0.5% by weight) of the acrylic polymer binder used in Example 5 had been added. The dye was applied using a laboratory gravure coater, and was air dried at room temperature. A 55 watt $CO_2$ laser was focused to a roughly circular spot size of 0.010 inch in diameter, and the spot was scanned over the desired pattern area at speeds ranging from 37.6 inches/second to 452 inches/second. The fabric was washed in a household-type washing machine using a household laundry product to remove unfixed dye. The fabric was then tumble-dried in a household-type dryer on a permanent press setting. The resulting fabric showed clear, dark, precisely defined dyed areas where scanned by the laser. The dyed areas also exhibited a sculptured effect, resulting from moderate superficial melting of fibers in the scanned areas. The dyed area and sculptured areas were in perfect registry. The background areas remained unchanged.

EXAMPLE 7

The procedures of Example 6 were followed, except for the following changes. The fabric was a previously dyed 100% polyester napped pile fabric having a weight of 10 oz. per square yard. This fabric is identified by Milliken & Company as Style No. 8301. The dye used was a formulation of 1.28% (weight) Polyester Blue GLF (Color Index Name Disperse Blue 27), a product of Eastman Chemical Products, Inc., a Division of Eastman Kodak, Rochester, N.Y., 1.18% (weight) Terasil Brilliant Pink 2GLA (Color Index Name Disperse Red 86), a product of Ciba Geigy, Greensboro, N.C., 3.54% (weight) of Terasil Yellow GWL (Color Index Name Disperse Yellow 42), also a product of Ciba Geigy, 1.0% (weight) Natrasol 250 HHXR, a cellulosic binding agent, which is a product of Hercules, Inc., Wilmington, Del. 19899, and 93% (weight) water. This dye was applied using a laboratory gravure coater to give a wet add-on of 10%. The wet fabric was then air dried at room temperature. The laser was scanned at speeds between 18.7 inches/second and 113 inches/second. The resulting dyed fabric exhibited good color development and well defined, in-registry sculpturing in those areas scanned by the laser. The background areas remained unchanged.

EXAMPLE 8

The fabric of Example 7 was dyed using a dye formulation of 4% (weight) Foron Black EDC (powdered), a product of Sandoz Color and Chemicals, Inc. of E. Hanover, N.J. 07936, 0.5% (weight) "PD-75", an acrylic polymer binder distributed by Milliken Chemical, Inman, S.C., and 95.5% (weight) water. The dye and heat were applied using the devices and procedures used for the same style fabric in Example 1. Coloring and sculpturing appeared in perfect registration, with no visually detectable dye in background areas.

EXAMPLE 9

An acrylic tufted fabric identified by Milliken & Company as Style No. 5299 (see Example 1) was dyed using a dye formulation of 2.8% (weight) Terasil Black MF-1, distributed by Ciba Geigy Corporation Greensboro, N.C. 27419, 0.1% (weight) Natrasol EX, a hydroxyethyl cellulose compound marketed by Hercules, Inc., Wilmington, Del. 19899, 1.0% (weight) "PD-75", an acrylic polymer binder distributed by Milliken Chemical, Inman, S.C., and 96.9% (weight) water. The dye and heat were applied using the devices and procedures used for the same style fabric in Example 1. Coloring and sculpturing appeared in perfect registration, with no visually detectable dye in background areas.

I claim:

1. A method for dyeing the surface of a thermoplastic textile substrate in areas defining a desired pattern configuration comprising the steps of:

(a) applying, substantially uniformly, a heat fixable dye material to said substrate surface without fixing said dye; and (b) applying heat selectively to said substrate surface in said areas defining said desired pattern configuration, said heat being sufficient to fix at least a portion of said dye material in said areas, while dye material applied to said substrate surface outside said areas is maintained outside said areas in substantially unfixed condition and unchanged distribution.

2. The method of claim 1 wherein unfixed dye material is removed from said substrate surface as a final step.

3. The method of claim 1 wherein said dye material is applied in liquid form.

4. The method of claim 3 which further comprises the step, following the application of said dye material to said substrate and prior to the fixing of said dye material, of drying said substrate surface to a substantially dry condition while leaving said applied dye material on said substrate surface in substantially uniformly distributed and substantially unfixed condition.

5. The method of claim 1 wherein said heat is applied to said areas non-uniformly.

6. The method of claim 1 wherein said heat applied to said substrate surface in said areas defining said desired pattern configuration is sufficient to permanently thermally modify said substrate surface in at least portions of said areas.

7. The method of claim 6 wherein said heat is sufficient to substantially longitudinally shrink components of said substrate surface.

8. The method of claim 6 wherein said heat is sufficient to melt portions of components of said substrate surface.

9. The method of claim 1 wherein said heat applied to said substrate surface in said areas defining said desired pattern configuration is applied by selective impingement by a stream of heated fluid.

10. The method of claim 9 wherein the temperature of said heated fluid applied to said areas is varied in accordance with pattern information.

11. The method of claim 1 wherein said heat applied to said substrate surface in said areas defining said desired pattern configuration is applied by a laser.

12. The method of claim 4 wherein said heat generated on said substrate surface in said areas defining said desired pattern configuration is applied by a heated mass pressed against said substrate surface in said areas.

13. A method for dyeing the surface of a thermoplastic textile substrate in areas defining a desired pattern configuration comprising the sequential steps of:

(a) applying, substantially uniformly, a component mixture of two heat fixable dye materials, one of said component dye materials having a distinctly lower fixation energy level than the other of said component dye materials, without fixing either of said dye materials;

(b) applying heat to said substrate surface in selected of said areas comprising said desired pattern configuration, said heat being sufficient to fix a quantity of said dye materials having said lower fixation energy level without fixing to a significant degree said other of said component dye materials, and;

(c) applying heat to said substrate surface in selected other of said areas comprising said desired configuration, said heat being sufficient to fix a quantity of both.

14. The method of claim 13 wherein unfixed dye material is removed from said substrate surface as a final step.

15. The method of claim 13 wherein said dye materials are applied in liquid form.

16. The method of claim 15 which further comprises the step, following the application of said dye materials to said substrate and prior to the fixing of either of said dye materials, of drying said substrate surface to a substantially dry condition while leaving said applied dye material on said substrate surface substantially uniformly distributed and in substantially unfixed condition.

17. The method of claim 13 wherein heat is applied substantially uniformly to said substrate surface carrying said dye materials, said heat being sufficient to fix one of said dye materials at a substantially uniform level of fixation over said substrate surface.

18. The method of claim 13 wherein said heat is applied to said areas non-uniformly.

19. The method of claim 13 wherein said heat applied to said substrate surface in said areas defining said desired pattern configuration is sufficient to permanently thermally modify said substrate surface in at least portions of said areas.

20. The method of claim 19 wherein said heat is sufficient to substantially longitudinally shrink components of said substrate surface.

21. The method of claim 19 wherein said heat is sufficient to melt portions of components of said substrate surface.

22. The method of claim 13 wherein said heat applied to said substrate surface in said areas defining said desired pattern configuration is applied by selective impingement by a stream of heated fluid.

23. The method of claim 22 wherein the temperature of said heated fluid applied to said areas is varied in accordance with pattern information.

24. The method of claim 13 wherein said heat applied to said substrate surface in said areas defining said desired pattern configuration is applied by a laser.

25. The method of claim 16 wherein said heat generated on said substrate surface in said areas defining said desired pattern configuration is applied by a heated mass pressed against said substrate surface in said areas.

* * * * *